US009790725B2

(12) United States Patent
Leborgne

(10) Patent No.: US 9,790,725 B2
(45) Date of Patent: Oct. 17, 2017

(54) DEVICE FOR SLOWING AND BLOCKING ONE VEHICLE ELEMENT RELATIVE TO ANOTHER

(71) Applicant: Faurecia Interieur Industrie, Nanterre (FR)

(72) Inventor: Olivier Leborgne, Warluis (FR)

(73) Assignee: Faurecia Interieur Industrie, Nanterre (FR)

( * ) Notice: Subject to any disclaimer, the term of this patent is extended or adjusted under 35 U.S.C. 154(b) by 0 days.

(21) Appl. No.: 14/245,219

(22) Filed: Apr. 4, 2014

(65) Prior Publication Data

US 2014/0298614 A1 Oct. 9, 2014

(30) Foreign Application Priority Data

Apr. 9, 2013 (FR) ..... 13 53158

(51) Int. Cl.

| | |
|---|---|
| ***E05B 83/30*** | (2014.01) |
| ***E05C 19/02*** | (2006.01) |
| ***E05F 5/08*** | (2006.01) |
| *E05B 15/04* | (2006.01) |

(52) U.S. Cl.

CPC ..... *E05F 5/08* (2013.01); *E05B 83/30* (2013.01); *E05C 19/02* (2013.01); *E05B 2015/0493* (2013.01); *Y10T 16/625* (2015.01)

(58) Field of Classification Search

CPC ..... Y10T 16/53836; Y10T 16/5384; Y10T 16/5275; Y10T 16/528; Y10T 16/5285; Y10T 16/8275; E05D 3/18; E05D 7/06; E05F 1/16; E05F 3/18; E05F 5/003; E05B 83/28; E05B 83/30; E05B 2015/0493

USPC ..... 16/291, 293, 362; 312/222

See application file for complete search history.

(56) References Cited

U.S. PATENT DOCUMENTS

| | | | | |
|---|---|---|---|---|
| 4,635,763 | A | 1/1987 | Omata | |
| 4,947,583 | A * | 8/1990 | Inui et al. | 49/193 |
| 5,187,836 | A * | 2/1993 | Kim et al. | 16/231 |
| 7,319,892 | B2 * | 1/2008 | Kato | 455/575.4 |
| 7,953,464 | B2 * | 5/2011 | Park et al. | 455/575.4 |
| 8,776,318 | B2 * | 7/2014 | Yamaguchi | 16/302 |
| 2005/0164753 | A1 * | 7/2005 | Kato | 455/575.4 |
| 2005/0272488 | A1 * | 12/2005 | Zou | 455/575.4 |

(Continued)

FOREIGN PATENT DOCUMENTS

| | | | |
|---|---|---|---|
| DE | 102004037120 | A1 | 3/2006 |
| GB | WO2007/147626 | * | 12/2007 |
| WO | W02007031351 | A1 | 3/2007 |

OTHER PUBLICATIONS

French Search Report for corresponding application No. FR 13 53158, Jan. 24, 2014, 3 pages. (in French).

*Primary Examiner* — Emily Morgan

(74) *Attorney, Agent, or Firm* — Reising Ethington P.C.

(57) ABSTRACT

A blocking device that includes a blocking pin movable on the first element between an unblocked position and a blocked position, and an actuating element secured to the second element and arranged to move the blocking pin. The blocking pin is fastened to the first element by a stressing element arranged to exert a force stressing the blocking pin toward its unblocked position between the unblocked position and an intermediate position of the blocking pin, and to exert a force stressing the blocking pin toward its blocked position between the intermediate position and the blocked position of the blocking pin.

10 Claims, 4 Drawing Sheets

(56) References Cited

U.S. PATENT DOCUMENTS

| | | | | |
|---|---|---|---|---|
| 2007/0032278 | A1* | 2/2007 | Lee et al. | 455/575.4 |
| 2008/0301909 | A1* | 12/2008 | Chien et al. | 16/362 |
| 2010/0001539 | A1 | 1/2010 | Kikuchi et al. | |
| 2011/0052253 | A1 | 3/2011 | Nieda | |
| 2011/0252603 | A1* | 10/2011 | Mitsui et al. | 16/362 |
| 2012/0001447 | A1 | 1/2012 | Simon et al. | |
| 2012/0025686 | A1* | 2/2012 | Darney | 312/405 |
| 2012/0222268 | A1* | 9/2012 | Yamaguchi | 16/302 |

* cited by examiner

DEVICE FOR SLOWING AND BLOCKING ONE VEHICLE ELEMENT RELATIVE TO ANOTHER

TECHNICAL FIELD

The present invention relates to a device for blocking a first element relative to a second element for a vehicle, of the type comprising a blocking pin movable on the first element between an unblocked position and a blocked position, in which said pin is blocked on the first element, and an actuating element secured to the second element and arranged to move the blocking pin between the unblocked position and the blocked position during the movement of the second element relative to the first element, the second element being blocked relative to the first element when the blocking pin is in its blocked position.

The invention also relates to a storage device for a vehicle comprising such a blocking device.

BACKGROUND

The invention more particularly applies to a storage device provided in the dashboard of a vehicle and comprising a drawer, such as a glove box. In such a storage device, the drawer moves toward its open position for example due to gravity after a user has unlocked the drawer.

In this case, it is necessary to provide an end-of-travel damping device for the drawer so as to slow it near its open position and prevent it from reaching its open position too abruptly, which could cause its contents to be ejected and reduce the quality perceived by the user. Furthermore, the drawer should be locked in its open position so as to avoid untimely closures and so as to give an impression of robustness and solidity to the user, who must then exert a certain force on the drawer to close it.

The slowing function and the blocking in the open position function are generally performed by different components, such as an air retarder or a spring plunger for slowing and locking by strike or "push-push" system for locking in the open position. Thus, the structure of the storage device is complicated and expensive due to the large number of components provided in the device.

Furthermore, the structure and position of the components allowing slowing of the drawer are complex because that slowing only occurs at the end of travel of the drawer, when it is close to its open position, and not over its entire travel between its closed position and its open position.

SUMMARY

One of the aims of the invention is to offset these drawbacks by proposing a device for blocking one element relative to another, making it possible both to slow the element relative to the other and block it when an element is at the end of its travel.

To that end, the invention relates to a blocking device of the aforementioned type, in which the blocking pin is fastened to the first element by a stressing element, said stressing element being moved with the blocking pin by the actuating element and being arranged to exert a force stressing the blocking pin toward its unblocked position between the unblocked position and an intermediate position of the blocking pin and to exert a force stressing the blocking pin toward its blocked position between the intermediate position and the blocked position of the blocking pin.

Thus, first, the second element moves relative to the first element against the stress force from the stressing element, which causes slowing of that movement, then secondly, after the passage at the intermediate position, the stressing element stresses the blocking pin into its blocked position, which locks that blocked position. Consequently, the slowing of the movement of one element relative to the other and the blocking of that element at the end of travel are done by a single blocking device, which simplifies and reduces the manufacturing costs for a storage device or other device comprising such a blocking device.

According to other features of the blocking device according to the invention:

- the stressing element comprises a first end rotatably mounted on the first element and a second end secured to the blocking pin, a spring extending between the first and second ends and being arranged to exert the stressing force on the blocking pin;
- the stressing element comprises a first branch extending from the spring to the first end and a second branch extending from the spring to the second end, the first and second branches forming a non-zero angle between them;
- the blocking pin is movable in a groove provided on the first element, the shape of said groove defining the path of said pin between its unblocked position and its blocked position;
- the groove extends substantially rectilinearly between a first and a second end part in a movement direction of the second element relative to the first element, the first and second end parts each forming a non-zero angle with the rectilinear part of the groove, the blocking pin being found in the first end part in the unblocked position and the second end part in the blocked position;
- the device comprises a stop element, the blocking pin abutting against said stop element when the blocking pin is in the first end part of the groove;
- the actuating element comprises a housing with a shape substantially complementary to the shape of part of the blocking pin, said blocking pin engaging in said housing during its movement between its unblocked position and its blocked position and being retained in said housing in the blocked position; and
- the actuating element comprises an engaging surface emerging on the housing, said engaging surface coming into contact with the blocking pin in the unblocked position and guiding said blocking pin toward the housing during the movement of said pin toward its blocked position.

The invention also relates to a storage device for a vehicle, of the type comprising a blocking device as described above, said storage element being translatable relative to the support element between a closed position, in which the support element closes the storage volume, and an open position, in which the storage element is withdrawn from the support element and the storage volume is accessible, the device comprising a blocking device as defined above, the blocking pin being movably mounted on the support element, on the storage element, respectively, and the actuating element being secured to the storage element, the support element, respectively, the blocking pin being in its blocked position when the storage element is in its open position.

According to another feature of the storage device, the movement between the unblocked position and the blocked position of the blocking pin corresponds to a translation of the storage element at the end of travel near the open position of the storage element.

BRIEF DESCRIPTION OF THE DRAWINGS

Other aspects and advantages of the invention will appear upon reading the following description, provided as an example and done in reference to the appended drawings, in which.

DETAILED DESCRIPTION

Figure 1:
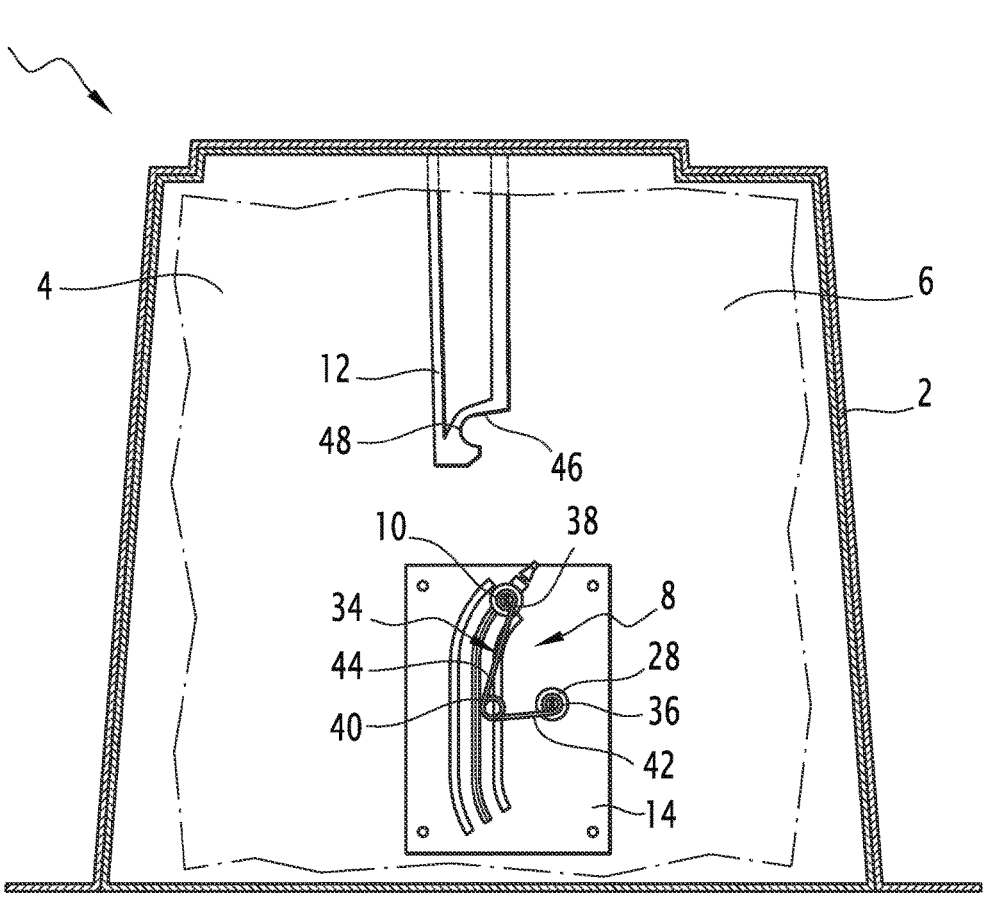
FIGS. 1 and 2 are bottom views of a storage device comprising a blocking device according to the invention, in the closed position and in the open position of the storage element, respectively.
Figure 2:
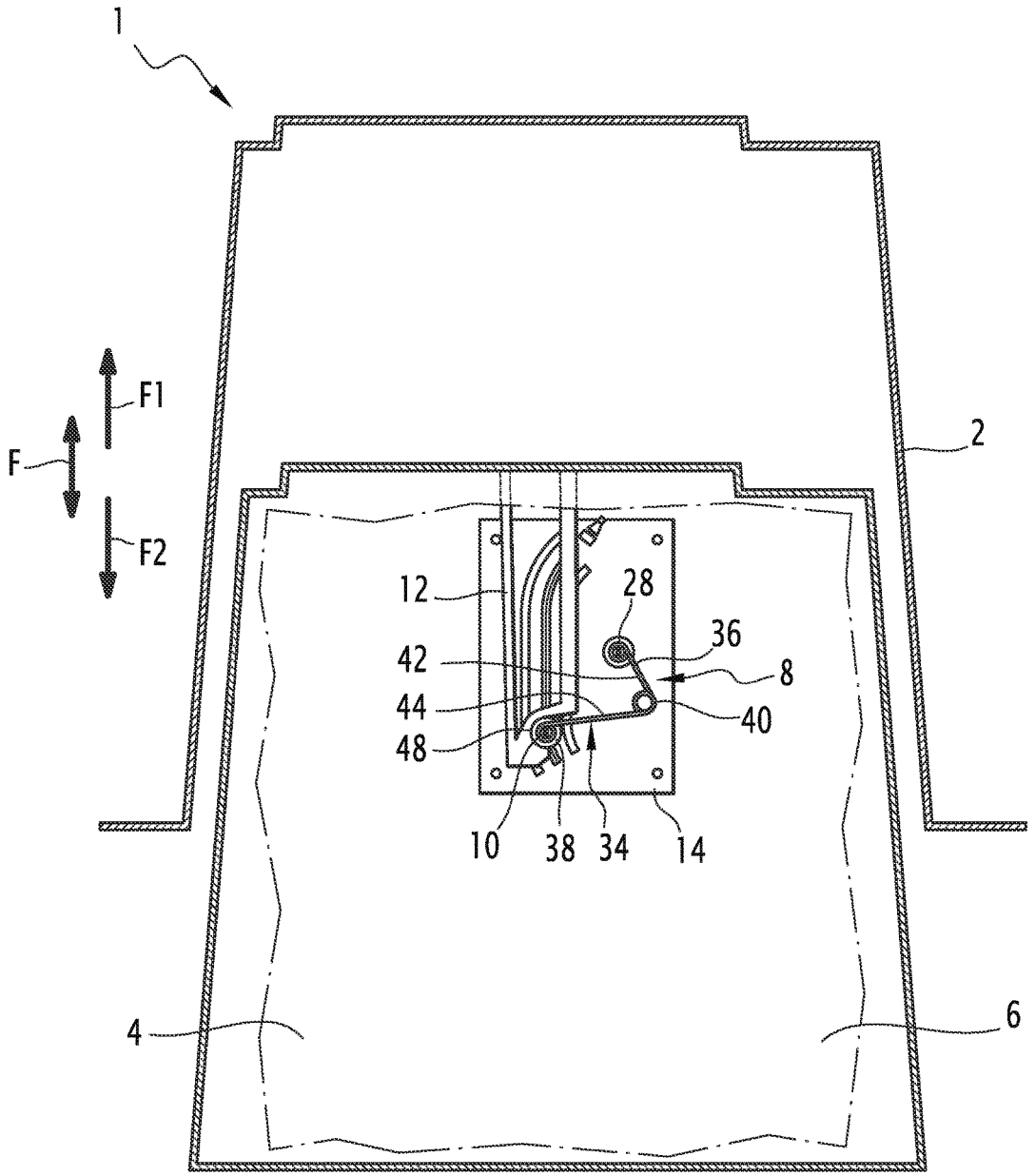

In reference to FIGS. 1 and 2, a storage device 1 comprising a support element 2 and a storage element 4 is described.

The support element 2 is for example formed by the body of a dashboard in which the storage device 1 is arranged. The support element 2 defines an inner volume inside which the storage element 4 can be received. The storage element 4 is mounted movably relative to the support element 2 between a closed position, in which the storage element 4 extends in the inner volume of the support element 2, as shown in FIG. 1, and an open position, in which the storage element 4 protrudes from the support element 2 so as to be accessible from the outside of the support element 2, as shown in FIG. 2. More particularly, the storage element 4 defines a storage volume 6, which is closed by the support element 2 in the closed position and which is accessible from outside the support element 2 in the open position. To that end, the storage element 4 is for example made in the form of a drawer. The storage element 4 includes a bottom and a front face. The bottom constitutes an upstream edge and the front face constitutes a downstream edge of the storage element. Traditionally, the storage device 1 comprises means for locking the storage element 4 in the closed position (not shown), which can be actuated by a user to cause the storage element 4 to go to the open position.

The movement of the storage element 4 relative to the support element 2 for example occurs in translation in a movement direction F. When the support element 2 is integrated into a vehicle dashboard, the movement direction F for example extends along the length of the vehicle and is inclined relative to the horizontal. In that case, the storage element 4 opens toward the rear of the vehicle, i.e., toward the passengers of the vehicle, under the effect of gravity, due to the incline of the drawer and its weight. The transition to the open position therefore occurs without any effort by the user after the latter has unlocked the storage element 4 in its closed position.

A device 8 for blocking the storage device 1 in the open position described above will now be described, in which the support element 2 forms a first element and the storage element 4 forms a second element. It is, however, understood that the blocking device 8 according to the invention can be used with other types of storage device 1, for example comprising another form of storage element or a different opening kinematic. The blocking device 8 according to the invention can also be adapted to other types of first and second elements, as long as one of the elements is movable relative to the other and requires damping and an end-of-travel blocking of its movement.

The blocking device 8 comprises a blocking pin 10, for example provided on the support element 2, and an actuating element 12, for example provided on the storage element 4.

The blocking pin 10 is mounted on a support plate 14 extending across from the storage element 4 and fastened to the support element 2 in the vicinity of the opening thereof, allowing the passage of the storage element 4 toward its open position, i.e., in the vicinity of a downstream edge of the support element 2 in reference to the movement direction of the storage element 4 toward its open position, as shown in FIGS. 1 and 2.

Figure 4:
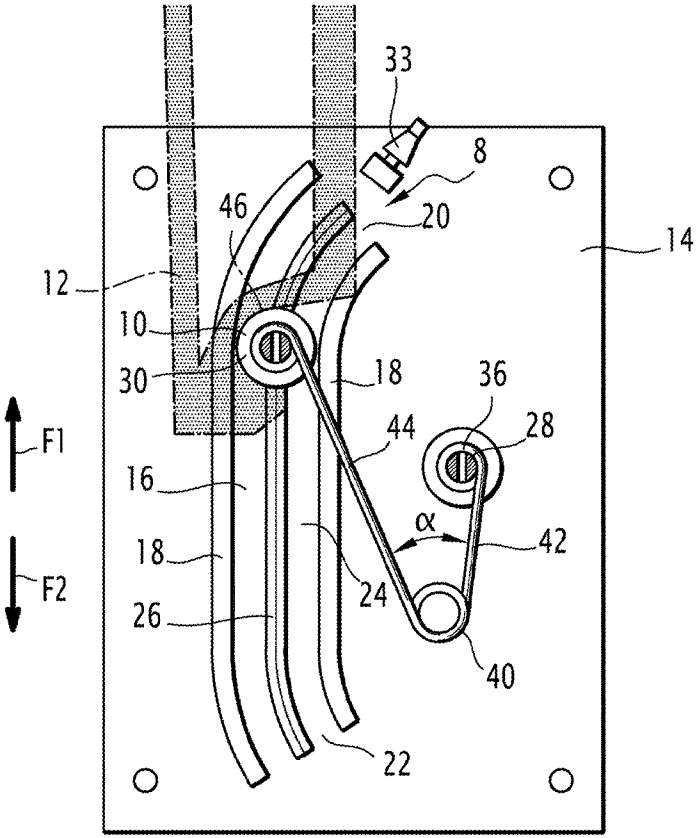
FIGS. 3 to 5 are diagrammatic top illustrations of the blocking device according to the invention, in the unblocked position, the intermediate position, and the blocked position of the device, respectively.
Figure 3:
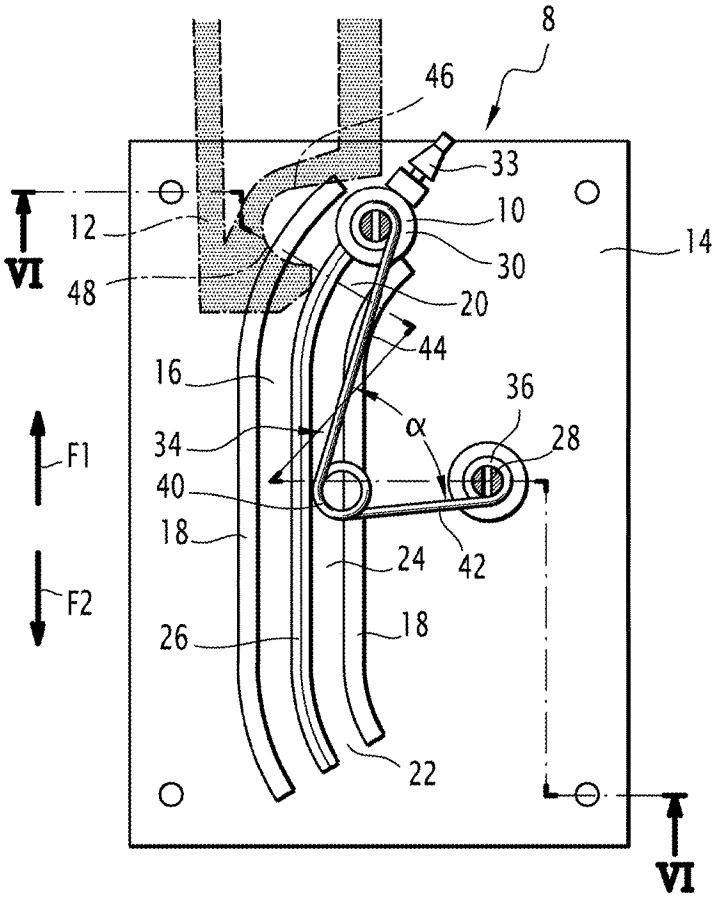
Figure 6:
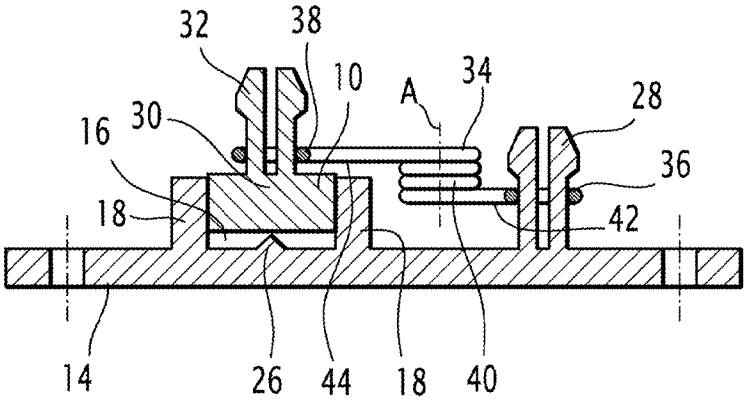
FIG. 6 is a diagrammatic cross-sectional illustration of the blocking device along axis VI-VI of FIG. 3.
Figure 5:
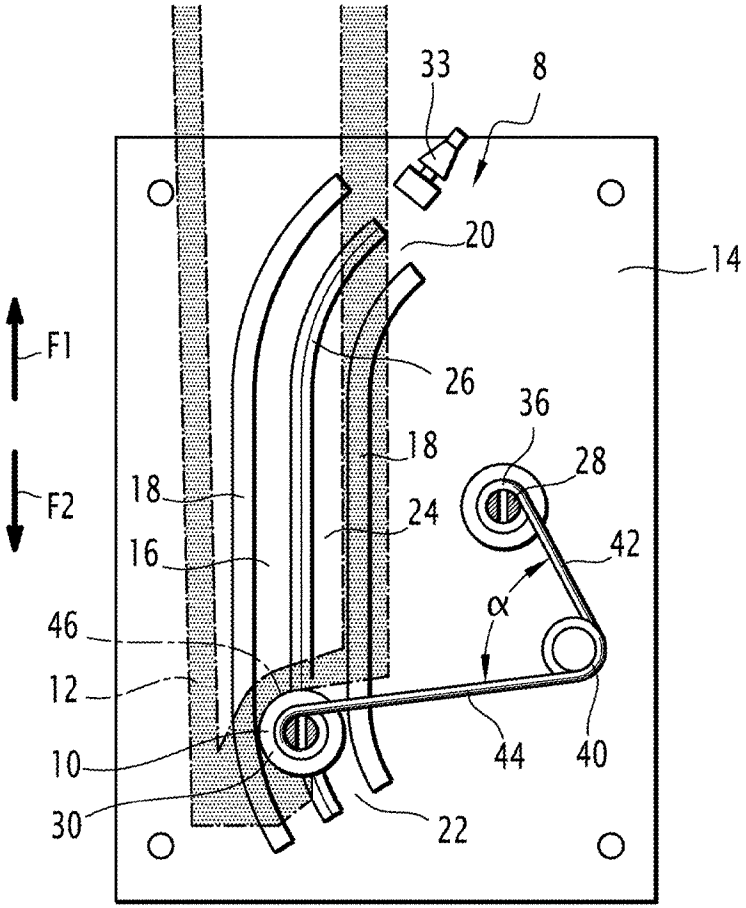

The blocking pin 10 is mounted movably in a groove 16 of the support plate 14, the groove being delimited by two parallel walls 18 extending protruding from the support plate 14, as shown in FIG. 6, toward the storage element 4. The walls 18 are parallel to each other and are separated from each other by a distance substantially equal to the diameter of the blocking pin 10, so as to ensure maintenance of the blocking pin 10 in the groove 16. The groove 16 extends between a first end part 20 and a second end part 22 connected to each other by a substantially rectilinear portion 24 extending in the movement direction F, as shown in FIGS. 3 to 5. The first and second end parts 20 and 22 each form a non-zero angle with the rectilinear portion 24 of the groove 16, i.e., the end parts 20 and 22 are inclined relative to the movement direction F. According to the embodiment shown in the figures, the first and second parts 20 and 22 extend on the same side of the groove 16 and are substantially symmetrical to one another relative to a plane passing through the center of the rectilinear portion 24 and substantially perpendicular to the movement direction F.

A rib 26 may be provided at the bottom of the groove 16 between the walls 18. This rib protrudes from the support plate 14 and ends in a tip. The blocking pin 10 is provided on the tip of the rib 26, as shown in FIG. 6, so as to limit the contact surface between the blocking pin 10 and the support plate 14 and facilitate its movement in the groove 16.

The support plate 14 further comprises a shaft 28 protruding from the support plate 14 parallel to the groove 16, substantially in the plane passing through the center of the rectilinear portion 24 of the groove 16 and substantially perpendicular to the movement direction F. Thus, the shaft 28 extends substantially equidistantly from the first and second end parts 20 and 22 of the groove 16.

The blocking pin 10 comprises a substantially cylindrical body 30, positioned and retained in the groove 16, and a shaft 32 extending protruding from the body 30 substantially parallel to the shaft 28 of the support plate 14 and coming out of the groove 16, as shown in FIG. 6. The support plate 14 further comprises a stop element 33 extending across from the body 30 of the blocking pin 10 in a direction substantially parallel to the direction in which the first end 20 of the groove 16 extends, i.e., substantially inclined relative to the rectilinear portion 24 of the groove 16, and is positioned across from the first end 20 of the groove 16. The function of this stop element 33 will be described later.

The blocking pin 10 is connected to the shaft 28 of the support plate 14, and therefore the support element 2, by a stressing element 34, rotatably mounted on the shaft 28 of the support plate 14 by its first end 36, and fastened to the shaft 32 of the blocking pin 10 by its second end 38. Between its first end 36 and its second end 38, the stressing element 34 comprises a spring 40, of the torsion spring type, for example helical, extending around an axis A substantially parallel to the shaft 28 of the support plate 14 and the shaft 32 of the blocking pin 10. The spring 40 is connected to the first end 36 of the stressing element 34 by a first branch 42 and the second end 38 of the stressing element 34 by a second branch 44. The first and second branches 42, 44 form a non-zero angle α between them, i.e., the first and second branches 42 and 44 are not aligned. The angle α is adapted based on the distance separating the two end parts 20 and 22 of the groove 16 and their distances relative to the shaft 28. According to the embodiment shown in figures, the spring 40, the first and second branches 42 and 44 and the first and second ends 36 and 38 are formed in a single piece, the first and second branches and ends being formed by the end parts of the spring 40.

Such a stressing element is said to be "bi-stable". This means that it is stable in two positions when no stress is exerted on it and it tends to return to one or the other of those positions when a stress is exerted on it. The two stable positions of the stressing element 40 correspond to the positions in which the blocking pin 10 is found in one of the end parts 20 and 22 of the groove 16, as shown in FIGS. 3 and 5. Between these two positions, the blocking pin 10 is in the rectilinear portion 24 of the groove 16 and exerts a stressing force on the stressing element tending to bring the blocking pin 10 into the first end part 20 of the groove 16, when the blocking pin 10 is between the first end part 20 and an intermediate position (shown in FIG. 4), and tending to bring back the blocking pin to the second end part 22, when the blocking pin 10 is found between the intermediate position and the second end part 22. This means that between the blocked position and the intermediate position, the stressing element 34 exerts a force tending to bring back the blocking pin 10 toward the unblocked position, and, between the intermediate position and the blocked position, the stressing element exerts a force tending to bring back the blocking pin 10 toward the blocked position. According to the embodiment shown in the figures, the intermediate position corresponds to a position in which the blocking pin 10 is substantially at the center of the rectilinear portion 24 of the groove 16.

Between the first end part 20 and the intermediate position, the stressing element 34 pushes the blocking pin 10 in a first direction F1. For example, the first direction F1 is oriented toward the bottom of the storage element 4. Between the intermediate position and the second end part 22, the stressing element 34 pushes the blocking pin in a second direction F2, different from F1. In one embodiment, the second direction F2 is opposite the first direction F1. For example, F2 is oriented toward the front face of the storage element 4.

The direction F1 is oriented in the closing direction of the storage element 4. The direction F2 is oriented in the opening direction of the storage element 4.

In other words, between the unblocked position and the intermediate position, the stressing element exerts a stressing force on the pin in the first direction F1, and between the intermediate position and the blocked position, the stressing element exerts a stressing force on the pin in the second direction F2, opposite the first direction F1.

The actuating element 12 is fastened to the storage element 4 across from the support element 2 and in the part of the storage element 4 remaining in the inner volume of the support element 2 in the open position and extending in the vicinity of the opening thereof, i.e., in the vicinity of an upstream edge of the storage element 4 in the direction of movement of the storage element 4 toward its open position, as shown in FIGS. 1 and 2. The actuating element 12 is more particularly positioned so as to come in contact with the blocking pin 10 during movement of the storage element 4 toward its open position. Due to the position of the actuating element 12 toward the upstream edge of the storage element 4, it will be understood that this contact between the actuating element 12 and the blocking pin 10 is done at the end of travel of the storage element 4, i.e., when the latter is approaching its open position.

The actuating element 12 is formed by a rigid tab extending substantially in the direction of movement F and comprising, at its downstream end positioned across from the blocking pin 10, an engaging surface 46 that is inclined relative to the movement direction F. The engaging surface 46 is for example substantially parallel to the walls 18 of the groove 16 in the first end part 20 thereof. The engaging surface 46 is arranged to come into contact with part of the blocking pin 10, for example its shaft 32, so as to allow the movement thereof in the groove 16, as will be described later.

The actuating element 12 further comprises a housing 48 with a shape substantially complementary to the shape of a part of the blocking pin 10, for example its shaft 32, in which the engaging surface 46 emerges. The concave side of the housing 48 is inclined relative to the movement direction. More particularly, the concave side of the housing 48 for example extends in a direction substantially perpendicular to the movement direction F and is turned toward the shaft 28 of the support plate 14 when the actuating element 12 is across from the groove 16.

The operation of the blocking device 8 described above will now be described in relation to the movement of the storage element 4 relative to the support element 2. It should be noted that this operation remains the same when the first element is formed by something other than a support element and when the second element is formed by something other than a storage element.

In the closed position of the storage element 4, the blocking pin 10 is found in the first end part 20 of the groove 16, which is closest to the actuating element 12, as shown in FIG. 1. In the absence of any other stress, the blocking pin 10 is kept in this first end part 20 under the effect of the stressing element 34. The blocking pin 10 is then in its unblocked position.

The blocking pin 10 is closer to the bottom of the storage element 4 when it is in its unblocked position than when it is in its blocked position.

When the storage element 4 is moved toward its open position, the actuating element 12 comes closer to the blocking pin 10.

The engaging surface 46 comes into contact with the blocking pin 10, as shown in FIG. 3, when the storage element 4 is close to its open position, i.e., at the end of travel of the storage element 4. According to one particular embodiment, the entry into contact between the engaging surface 46 and the blocking pin 10 occurs when the storage element 4 must again travel a path of approximately 50 mm in the movement direction to reach its open position.

The storage element 4 continues its travel toward its open position and the actuating element 12 then exerts a force on the blocking pin 10 against the stressing force exerted on the blocking pin 10 by the stressing element 34. The blocking pin 10 engages in the rectilinear portion 24 of the groove 16 while sliding on the engaging surface 46 of the actuating element 12 and moves in the groove 16 in the movement direction F toward the second end part 22 of the groove 16. This movement is accompanied by a rotation of the stressing element 34 around the shaft 28 of the support plate. This movement occurs against the stressing force 34 until the blocking pin 10 reaches the intermediate position, as shown in FIG. 4. Thus, during this movement to the intermediate position, the movement of the storage element 4 is damped due to the stressing force exerted by the stressing element 34 tending to bring the blocking pin 10 toward the first end part 20 of the groove 16. One thus obtains slowing of the storage element 4 at the end of travel. The amplitude of this slowing may be adjusted by modifying the stiffness of the spring 40.

The movement of the blocking pin 10 in the groove 16 is accompanied by sliding of the pin on the engaging surface 46 of the actuating element 12 toward the housing 48, as shown in FIG. 4.

When the storage element 4 is close to its open position, the blocking pin 10 reaches and exceeds the intermediate position in the groove 16. The stressing force exerted by the stressing element 12 changes direction and tends to bring the blocking pin 10 into the second end part 22 of the groove 16. Thus, the blocking pin 10 engages in the second end part 22 as well as in the housing 48 of the actuating element 12 and the open position of the storage element 4, as shown in FIG. 2. The blocking pin is then in its blocked position, as shown in FIG. 5. The blocked position is stable due to the stress exerted by the stressing element 34 on the blocking pin 10, which is kept in the second end part 22 of the groove 16. Furthermore, the position is blocked by the engagement of the blocking pin 10 in the housing 48 of the actuating element 12. Thus, the open position of the storage element 4 is stable and blocked, which prevents any untimely closing of the storage element 4 and offers an impression of robustness to the user.

The return of the storage element to the closed position causes a movement opposite to the movement previously described of the blocking pin 10 in the groove 16 and a return of that pin into the first end part 20 of the groove 16. First, the user must exert a certain force on the storage element 4 to drive it toward its closed position against the stressing force exerted by the stressing element 34 on the blocking pin 10. Next, when the blocking pin 10 has exceeded the intermediate position toward its unblocked position, the movement of the storage element 4 toward its closed position is assisted by the stressing force exerted by the stressing element 34 on the blocking pin 10.

The blocking pin abuts on the stop element 33, in the unblocked position, thereby limiting the risks of the body 30 exiting the groove 16. The stop element 33 is in flexible material, like an elastomer. The stop element 33 further makes it possible to damp the return of the blocking element 10 toward its unblocked position under the effect of the stressing force exerted on it by the stressing element 34.

Furthermore, when the storage device is in the closed position, the stop element 33 makes it possible to limit the vibrations as well as the noises coming from the blocking pin 10 during movement of the vehicle.

The blocking device 8 described above therefore makes it possible, with a device having a simple structure, both to slow the storage element at the end of travel when it approaches its open position and to offer blocking of the storage element in its open position.

As an alternative to the blocking device described above, it is understood that the blocking pin 10 could be provided on the storage element 4 and the actuating element 12 could be provided on the support element 12.

The invention claimed is:

1. A blocking device for a vehicle, comprising:

a first element;

a second element, wherein the second element is moveable relative to the first element;

a blocking pin movable between a first end part and a second end part relative to the first element, the blocking pin being movable between an unblocked position and a blocked position, wherein in the blocked position, said blocking pin is located at the second end part;

an actuating element secured to the second element, separate from the blocking pin, and arranged to move into contact with the blocking pin between the unblocked position and the blocked position during at least part of the movement of the second element relative to the first element and the actuating element is configured to be spaced from the blocking pin during at least part of the movement of the second element relative to the first element when the blocking pin is in the unblocked position; and a stressing element that fastens the blocking pin to the first element, said stressing element being moved with the blocking pin by the actuating element and being arranged to exert a force stressing the blocking pin toward its unblocked position when the blocking pin is between the unblocked position and an intermediate position of the blocking pin and to exert a force stressing the blocking pin toward its blocked position when the blocking pin is between the intermediate position and the blocked position of the blocking pin so that movement of the actuating element is required to move the second element relative to the first element when the blocking pin is in the blocked position.

2. The blocking device according to claim 1, wherein the stressing element comprises a first branch extending from a spring to a first end rotatably mounted on the first element and a second branch extending from the spring to a second end secured to the blocking pin, wherein the spring is arranged to exert the stressing force on the blocking pin and the first and second branches form a non-zero angle ($\alpha$) between them.

3. The blocking device according to claim 1, wherein the blocking pin is movable in a groove provided on the first element, the shape of said groove defining the path of said pin between its unblocked position and its blocked position.

4. The blocking device according to claim 3, wherein the groove extends substantially rectilinearly between the first and the second end part in a movement direction (F) of the second element relative to the first element, the first and second end parts each forming a non-zero angle with the rectilinear portion of the groove, the blocking pin being found in the first end part in the unblocked position.

5. The blocking device according to claim 3, wherein the device comprises a stop element, the blocking pin abutting against said stop element when the blocking pin is in the first end part of the groove.

6. The blocking device according to claim 1, wherein the actuating element comprises a housing with a shape substantially complementary to the shape of part of the blocking pin, said blocking pin engaging in said housing during its movement between its unblocked position and its blocked position and being retained in said housing in the blocked position.

7. The blocking device according to claim 6, wherein the actuating element comprises an engaging surface emerging on the housing, said engaging surface coming into contact with the blocking pin in the unblocked position and guiding said blocking pin toward the housing during the movement of said blocking pin toward its blocked position.

8. A storage device for a vehicle, comprising a blocking device according to claim 1, wherein the first element is a support element and the second element is a storage element defining a storage volume, said storage element being translatable relative to the support element between a closed position, in which the support element closes the storage volume, and an open position, in which the storage element is removed from the support element and the storage volume is accessible, wherein the blocking pin of the blocking device is in its blocked position when the storage element is in its open position.

9. The storage device according to claim 8, wherein the movement between the unblocked position and the blocked position of the blocking pin corresponds to a translation of the storage element at the end of travel in the vicinity of the open position of the storage element.

10. The blocking device according to claim 1, wherein the first element comprises a support plate.

* * * * *